United States Patent [19]

Morris

[11] 4,097,971

[45] Jul. 4, 1978

[54] CLIP APPARATUS

[75] Inventor: William E. Morris, Appleton, Wis.

[73] Assignee: Scolding Locks Corporation, Appleton, Wis.

[21] Appl. No.: 765,047

[22] Filed: Feb. 2, 1977

[51] Int. Cl.[2] ..... A44B 21/00; G09F 19/00

[52] U.S. Cl. ..... 24/253; 40/11 R

[58] Field of Search ..... 24/253, 252 R, 248 R; 40/1.5, 1.6, 11 R, 134, 16.6, 23 R; 32/48 R

[56] References Cited

U.S. PATENT DOCUMENTS

| | | | |
|---|---|---|---|
| 580,293 | 4/1897 | Peterson | 24/253 |
| 824,516 | 6/1906 | Suesskind | 40/16.6 |
| 1,074,102 | 9/1913 | Burke | 40/11 R |

FOREIGN PATENT DOCUMENTS

| | | | |
|---|---|---|---|
| 1,360,247 | 3/1963 | France | 40/11 R |
| 1,124,914 | 2/1966 | United Kingdom | 24/252 R |

*Primary Examiner*—Kenneth J. Dorner

*Attorney, Agent, or Firm*—Allegretti, Newitt, Witcoff & McAndrews

[57] ABSTRACT

A clip apparatus having an integral display member is disclosed herein. The integral display member includes a display section, arm section and tab section. The arm section is folded upon the display section and retained by the tab section. A biased clip member is secured to the arm section.

12 Claims, 3 Drawing Figures

CLIP APPARATUS

BACKGROUND AND SUMMARY OF THE INVENTION

The present invention relates generally to a clip apparatus and more particularly to a display device which is fastened or clipped to the user thereof.

The present invention fundamentally comprises a display member, clip member, and means for attaching and biasing the clip member. The display member is integral and includes a display section, arm section and tab section.

The arm and tab sections join the display section at substantially opposite edges thereof. In an assembled state, the arm section is folded upon the display section, and the tab section is folded upon the arm section for retention thereof.

The arm section has opposed flange portions, extending outwardly from the display section in the assembled state. The clip member is secured to the opposed flange portions.

It is thus an object of the present invention to provide a readily and inexpensively manufactured clip device. Another object is to provide a clip apparatus having an integral display member, whereby production thereof is facilitated.

Still another object of the present invention is to provide an integral display member for a clip apparatus having foldable arm and tab sections, whereby fabrication is substantially simplified by elimination of bonding steps, e.g., welding. It is also an object to provide an integral display member having a foldable arm section for attachment of a clip member.

These and other objects, features and advantages of the present invention are discussed and suggested in the following detailed description.

DESCRIPTION OF THE DRAWING

A preferred embodiment of the present invention is shown in the drawing wherein.

DESCRIPTION OF THE PREFERRED EMBODIMENT

Figure 1:
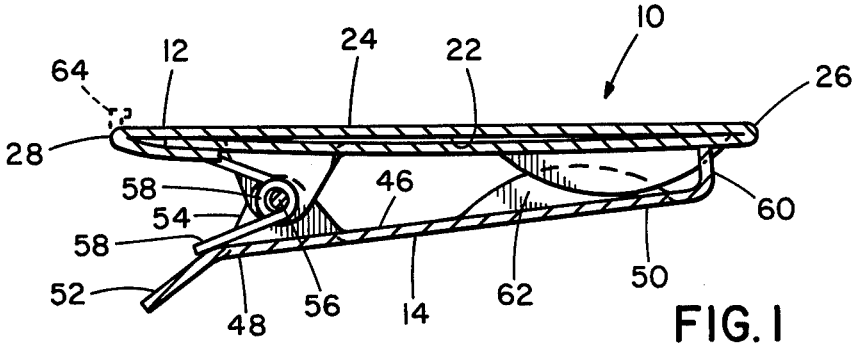
FIG. 1 is a cross-sectional view of a preferred embodiment of the present invention.

Referring to the drawing, a preferred embodiment of the present invention is shown as a clip apparatus 10. The clip apparatus 10 comprises a display member 12 and clip member 14.

Figure 3:
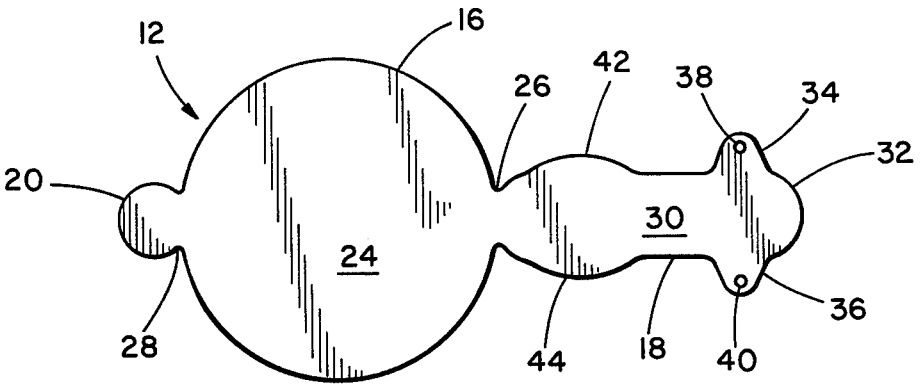
FIG. 3 is a front view of the display member, shown in FIG. 2, illustrated in an unassembled state.

The display member 12 is shown in FIG. 3 in an unassembled state. Referring thereto, the display member 12 is an integral, single-piece construction. Preferably a lightweight material, such as aluminum, the display member 12 includes a display section 16, arm section 18 and tab section 20.

The display section 16 has opposed first and second faces 22, 24 and opposed first and second edges 26, 28. As shown, the arm section 18 integrally joins the display section 16 at the first edge 26. The arm section 18 extends outwardly therefrom and substantially away from the second edge 28 in the unassembled state.

The arm section 18 has a stem portion 30, terminating in a rounded arm section end 32. A pair of opposed flange portions 34, 36 extend outwardly from the stem portion 30, substantially adjacent the rounded arm section end 32. The opposed flange portions 34, 36 are substantially parabolically shaped and define a pair of apertures 38, 40, respectively.

The arm section 18 also has a pair of opposed, substantially segment-shaped grasping portions 42, 44, interposed the display section 16 and rounded arm section end 32. As shown, the opposed grasping portions 42, 44 are substantially adjacent the first edge 26 of the display section 16. The arm section 18 tapers from the opposed grasping portions 42, 44 towards the first edge 26 to facilitate folding, as herein described.

The tab section 20 attaches, substantially opposite the arm section 18, to the second edge 28 of the display section 16. The tab section 20 is also substantially segment-shaped and tapers towards the second edge 28, whereby the tab section 20 is readily folded with respect to the display section 16. As shown, the extension of the tab section 20 from the display section 16 is substantially less than the extension of the arm section 18.

The unassembled display member 12 is preferably stamped from sheet material. Preferably in a continuous die process, the opposed flange portions 34, 36 and grasping portions 42, 44 are bent, with respect to the arm stem 30, towards the second face 24 of the display section 16. In this preferred embodiment, the opposed flange portions 34, 36 and grasping portions 42, 44 are substantially perpendicular to the arm stem 30.

Figure 2:
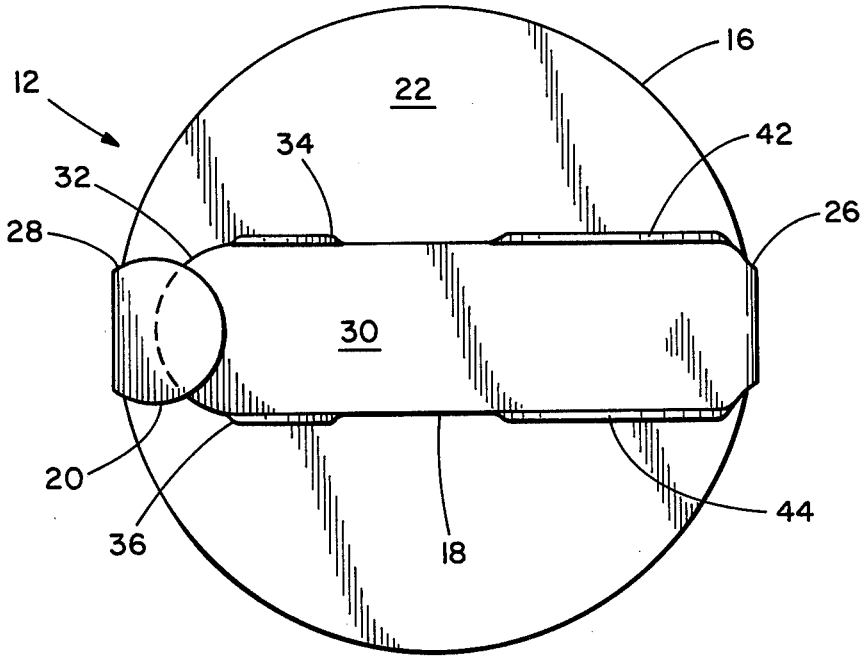
FIG. 2 is a back view of the display member shown in FIG. 1.

In the assembled state, shown in FIGS. 1 and 2, the arm section 18 is folded about the first edge 26 upon the first face 22 of the display section 16. The arm section 18, as folded, extends towards the tab section 20 and second edge 28.

The tab section 20 is folded, about the second edge 28, into engagement with the rounded arm section end 32 of the arm section 18. Due to its rigidity, the tab section 20 secures the arm section 18 in its folded position. That is, the tab section 20 maintains the arm section 18 and more particularly the rounded arm section end 32 tightly against the first face 22 of the display section 16. Bonding of any type is thereby eliminated from the fabrication process, substantially decreasing production time and costs.

Referring now to FIG. 1, the clip member 14 includes a shaft section 46, actuating end section 48 and clamping end section 50. The actuating end section 48 has a lever portion 52 bent, with respect to the shaft section 46, away from the display member 12. The actuating end section 48 also has a pair of opposed, substantially parabolically shaped ataching portions 54 (only one is shown in FIG. 1), substantially perpendicular to the shaft section 46.

The opposed attaching portions 54 have apertures and substantially mate with the opposed flange portions 34, 36 of the arm section 18. A pin 56 rotatably secures the display member 12 and clip member 14. A spring 58 biases the clamping end section 50 of the clip member 14 against the display member 12.

As shown, the clamping end section 50 includes a terminating lip portion 60 and a pair of opposed substantially segment-shaped clamping portions 62 (again only one is shown in FIG. 1). The opposed clamping portions 62 are substantially perpendicular to the shaft section 46 and adapted to mate with the opposed grasping portions 42, 44 of the arm section 18. The terminating lip portion 60 is substantially perpendicular to both the shaft section 40 and opposed clamping portions 62.

In this preferred embodiment, the display section 16 of the display member 12 is substantially circular. It is to be understood, however, that the shape thereof can be varied for any particular purpose or use.

The second face 24 of the display section 16 may bear an indicia or marking applied by conventional means. Further, the display section 16 may have, on the second face 24 thereof, a peripheral retaining lip portion 64, partially shown in phantom in FIG. 1, for receipt of an informative card, e.g, an identification card.

The clip apparatus 10 may also be used as a reflector. For such use, the second face 24 of the display section 16 is coated with a phosphorescent or reflective material. This embodiment of the present invention is particularly valuable to cyclists for night riding.

Preferred embodiments of the present invention have been disclosed and described herein. It is to be understood, however, that various changes and modifications can be made without departing from the true scope and spirit of the present invention, as defined by the following claims.

What is claimed is:

1. A clip apparatus, having an assembled state and an unassembled state, comprising, in combination:

an integral display member including a display section having opposed first and second faces and opposed first and second edges, an arm section extending from said first edge and substantially away from said second edge and said unassembled state, and a tab section extending from said second edge, said arm section having an arm section end opposite said first edge and a pair of opposed flange portions, said arm section being folded about said first edge upon said first face of said display section in said assembled state, said opposed flange portions extending outwardly from said first face in said assembled state, said tab section being folded about said second edge onto said arm section end in said assembled state to substantially retain said arm section against said first face;

a clip member having a grasping end portion;

means for rotatably securing said clip member to said opposed flange portions of said arm section in said assembled state; and means for biasing said grasping end portion of said clip member against said integral display member.

2. A clip apparatus as claimed in claim 1 wherein said display section is substantially circular.

3. A clip apparatus as claimed in claim 1 wherein said display member further includes a retaining lip portion on said second face.

4. A clip apparatus as claimed in claim 1 wherein said second face of said display section is phosphorescent.

5. A clip apparatus as claimed in claim 1 wherein said second face of said display section is reflective.

6. A clip apparatus as claimed in claim 1 wherein said arm section further has a pair of opposed grasping portions substantially adjacent said first edge of said display section, said opposed grasping portions extending outwardly from said first face in said assembled state.

7. A clip apparatus as claimed in claim 1 wherein said tab section is substantially segment-shaped and tapers towards said second edge of said display section to facilitate folding thereof.

8. A clip apparatus as claimed in claim 1 wherein said arm section tapers toward said first edge of said display section to facilitate folding thereof.

9. An improved display member comprising:

a display section having opposed first and second faces and opposed first and second edges;

an arm section integrally joined at said first edge and extending substantially away from said second edge in an unassembled state, said arm section having an arm section end opposite said first edge and a pair of opposed flange portions; and a tab section integrally joined at said second edge;

said arm section being folded about said first edge upon said first face of said display section in an assembled state, said opposed flange portions extending outwardly from said first face in said assembled state, said tab section being folded about said second edge onto said arm section end in said assembled state to substantially retain said arm section against said first face.

10. An improved display member as claimed in claim 9 wherein said second face of said display section is phosphorescent.

11. An improved display member as claimed in claim 9 wherein said second face of said display section is reflective.

12. An improved display member as claimed in claim 9 wherein said display section includes a retaining lip portion on said second face.

* * * * *